US011060532B2

(12) United States Patent
Vokel et al.

(10) Patent No.: US 11,060,532 B2
(45) Date of Patent: Jul. 13, 2021

(54) PRESSURE AMPLIFIER

(71) Applicant: PistonPower ApS, Soenderborg (DK)

(72) Inventors: Lubos Vokel, Povazska Bystrica (SK); Jorgen Mads Clausen, Soenderborg (DK); Tom Tychsen, Graasten (DK)

(73) Assignee: PistonPower ApS, Soenderborg (DK)

( * ) Notice: Subject to any disclaimer, the term of this patent is extended or adjusted under 35 U.S.C. 154(b) by 210 days.

(21) Appl. No.: 15/909,023

(22) Filed: Mar. 1, 2018

(65) Prior Publication Data

US 2018/0252240 A1 Sep. 6, 2018

(30) Foreign Application Priority Data

Mar. 3, 2017 (EP) ..... 17159044

(51) Int. Cl.

| | |
|---|---|
| ***F15B 3/00*** | (2006.01) |
| ***F04B 7/02*** | (2006.01) |
| ***F04B 9/105*** | (2006.01) |
| ***F04B 9/113*** | (2006.01) |
| ***F04B 9/103*** | (2006.01) |

(52) U.S. Cl.

CPC ..... *F15B 3/00* (2013.01); *F04B 7/0225* (2013.01); *F04B 9/103* (2013.01); *F04B 9/1056* (2013.01); *F04B 9/113* (2013.01); *F15B 2201/00* (2013.01)

(58) Field of Classification Search

CPC ..... F04B 7/02; F04B 7/0225; F04B 9/1056; F04B 9/08; F04B 9/1172; F04B 9/105; F04B 53/10; F04B 49/002; F15B 3/00; F15B 15/00; F15B 2215/30

USPC ..... 417/225, 399, 403

See application file for complete search history.

(56) References Cited

U.S. PATENT DOCUMENTS

| | | | | |
|---|---|---|---|---|
| 2,296,647 | A | 12/1942 | McCormick | |
| 2,508,298 | A | 5/1950 | Saari | |
| 2,991,130 | A * | 7/1961 | Sampietro | B60T 8/1843 303/22.7 |
| 3,037,488 | A | 6/1962 | Barrett | |
| 3,079,864 | A | 3/1963 | Drutchas et al. | |
| 3,081,706 | A | 3/1963 | Drutchas et al. | |
| 3,241,463 | A | 3/1966 | Barrett | |

(Continued)

FOREIGN PATENT DOCUMENTS

| | | |
|---|---|---|
| CN | 203348188 U | 12/2013 |
| CN | 103511382 A | 1/2014 |

(Continued)

OTHER PUBLICATIONS

First Examination Report for Indian Serial No. 201814004324 dated Feb. 28, 2020.

*Primary Examiner* — Charles G Freay
*Assistant Examiner* — Chirag Jariwala
(74) *Attorney, Agent, or Firm* — McCormick, Paulding & Huber PLLC

(57) ABSTRACT

A pressure amplifier (1) is described comprising a housing (2), an amplification piston (5) in the housing (2) having a high pressure area (9) in a high pressure chamber (5) and a low pressure area (8) in a low pressure chamber (3), and a switching valve (11) having a pressured control valve element having a larger pressure area (16) and a small pressure area (17). Such a pressure amplifier should have a high operating frequency. To this end the valve element (10) and the amplification piston (5) are located in a same bore (3, 4) in the housing (2).

21 Claims, 1 Drawing Sheet

(56) References Cited

U.S. PATENT DOCUMENTS

| | | | | |
|---|---|---|---|---|
| 3,391,538 | A | 7/1968 | Orloff et al. | |
| 3,579,985 | A | 5/1971 | Barrett | |
| 3,583,832 | A | 6/1971 | Lee, II | |
| 3,632,230 | A * | 1/1972 | Ueda | F01L 21/00 417/225 |
| 3,835,752 | A | 9/1974 | D'Amata | |
| 4,281,587 | A | 8/1981 | Garcia-Crespo | |
| 4,523,895 | A | 6/1985 | Silva | |
| 4,627,794 | A | 12/1986 | Silva | |
| 4,659,294 | A | 4/1987 | Barthomeuf | |
| 4,780,064 | A | 10/1988 | Olsen | |
| 6,295,914 | B1 * | 10/2001 | Iversen | F15B 3/00 91/300 |
| 6,497,558 | B1 | 12/2002 | Hale | |
| 6,619,243 | B2 | 9/2003 | Al-Hawaj | |
| 6,866,485 | B2 | 3/2005 | Hansen et al. | |
| 7,726,950 | B2 | 6/2010 | Hansen et al. | |
| 8,613,602 | B2 | 12/2013 | Iversen | |
| 2003/0097924 | A1 * | 5/2003 | Hansen | F04B 9/107 91/299 |
| 2003/0172652 | A1 | 9/2003 | Tohru | |
| 2004/0006983 | A1 | 1/2004 | Sawdon | |
| 2004/0115070 | A1 | 6/2004 | Baatrup et al. | |
| 2005/0013716 | A1 | 1/2005 | Magami et al. | |
| 2005/0123416 | A1 | 6/2005 | Smith | |
| 2006/0073037 | A1 * | 4/2006 | Pedersen | F15B 3/00 417/415 |
| 2009/0317267 | A1 | 12/2009 | Gill et al. | |
| 2014/0373524 | A1 | 12/2014 | Schuller et al. | |
| 2016/0053749 | A1 | 2/2016 | Hunter | |
| 2018/0252206 | A1 | 9/2018 | Krissak et al. | |
| 2018/0252241 | A1 | 9/2018 | Todsen et al. | |
| 2018/0252242 | A1 | 9/2018 | Hanusovsky et al. | |

FOREIGN PATENT DOCUMENTS

| | | | |
|---|---|---|---|
| CN | 203757349 | U | 8/2014 |
| DE | 3032430 | A1 | 3/1982 |
| DE | 102007031166 | A1 | 1/2009 |
| EP | 0692072 | B1 | 9/1999 |
| JP | S6224001 | A | 2/1987 |
| JP | S63243464 | A | 10/1988 |
| RU | 2056550 | C | 3/1996 |
| RU | 19404 | U1 | 8/2001 |
| RU | 24520 | U1 | 8/2002 |
| RU | 2513060 | C1 | 4/2014 |
| SU | 638751 | A1 | 12/1978 |
| SU | 1165818 | A1 | 7/1985 |

* cited by examiner

PRESSURE AMPLIFIER

CROSS-REFERENCE TO RELATED APPLICATION

This application claims foreign priority benefits under U.S.C. § 119 to European Patent Application No. 17159044.1 filed on Mar. 3, 2017, the content of which is hereby incorporated by reference in its entirety.

TECHNICAL FIELD

The present invention relates to a pressure amplifier comprising a housing, an amplification piston in the housing having a high pressure area in a high pressure chamber and a low pressure area in a low pressure chamber, and a switching valve having a pressure controlled valve element having a large pressure area and a small pressure area.

BACKGROUND

Such a pressure amplifier is known, for example, from U.S. Pat. No. 6,866,485 B2.

The amplification piston is in form of a stepped piston. The low pressure area is larger than the high pressure area. When a fluid, in particular a hydraulic fluid, acts on the low pressure area the pressure on the high pressure area is increased by the ratio between the low pressure area and the high pressure area.

When the amplification piston has performed an amplification stroke and has reached its end position, it has to be returned to the start of the stroke. To this end the high pressure chamber is supplied with the fluid under supply pressures, and the low pressure chamber is set to an even lower pressure, for example tank pressure. This pressure change in the low pressure chamber is controlled by the switching valve.

The switching valve is pressure controlled, i. e. the position of the valve element is controlled by pressure differences acting in the one or the other direction.

SUMMARY

The object underlying the present invention is to have a pressure amplifier with a high operating frequency.

This object is solved with a pressure amplifier as described at the outset in that the valve element and the amplification piston are located in a same bore in the housing.

The pressure controlling the position of the valve element is controlled by the amplification piston. When the amplification piston and the valve element are located in the same bore in the housing, there is at least one pressure which acts at the same time on the valve element and on the amplification piston. Therefore, the fluid can very quick come into action with the valve element and the reaction time of the valve element can be controlled. The shorter the reaction or response time is the higher can be the operation frequency of the pressure amplifier.

In an embodiment of the invention the amplification piston and the valve element have a common longitudinal axis. This facilitates the production of the bore.

In an embodiment of the invention the valve element has a first mechanical stop arrangement for a movement in a first direction and a second mechanical stop arrangement for a movement in a second direction opposite the first direction. The end positions of the valve element are determined by the stop arrangements. It is therefore possible to act with high forces onto the valve element of the switching valve and to keep at the same time defined switching positions of the valve element.

In an embodiment of the invention the first mechanical stop arrangement is arranged within the valve element in a direction of movement. The first mechanical stop arrangement can be, for example, realized by an radially outer flange on the valve element and a radially inner step in the bore in which the valve element is located.

In an embodiment of the invention the second mechanical stop arrangement is formed by a front face of the valve element and a plug closing the bore. This is a simple construction.

In an embodiment of the invention the plug comprises a circumferential wall surrounding an end of the valve element. In the region surrounded by the wall of the plug the valve element can have a reduced outer diameter.

In an embodiment of the invention the valve element comprises a shifting pressure area being connected via the amplification piston to high pressure or to low pressure. As mentioned above, the valve element of the switching valve is pressure controlled, wherein the controlled pressure is controlled by the amplification piston. The shift pressure area can be formed, for example, near the end of the valve element which is surrounded by the circumferential wall of the plug. This end of the valve element can have a reduced outer diameter in order to create a larger shift pressure area. The valve element can furthermore comprise a constant pressure area which is smaller than the shifting pressure area. By changing the pressure acting on the shifting pressure area the position of the valve element can be adjusted.

In an embodiment of the invention the amplification piston has a stroke dimensioned so that it hits the valve element at least in an end part of a return movement. In this case the valve element is shifted mechanically by the amplification piston, in particular during a return stroke. The return stroke is the stroke in which the amplification piston moves direction in which the high pressure chamber is increased and the low pressure chamber is decreased. In this way the response time of a valve element can be further reduced.

In an embodiment of the invention the valve element is loaded by an auxiliary force in a direction opposite to the return movement of the amplification piston. In this way the movement of the valve element in the opposite direction can be accelerated as well.

In an embodiment the auxiliary force is at least partly generated by a spring arrangement. The spring arrangement comprises at least one spring which is tensioned, for example compressed, during the return movement of the amplification piston. When the valve element is moved in the opposite direction, the spring expands to accelerate the valve element.

In an embodiment of the invention the auxiliary force is at least partly generated by a pressure in an accumulator. The accumulator can comprise, for example, a gas. The spring arrangement and the accumulator can be used alternatively or together.

In an embodiment of the invention the housing is part of a piston-cylinder-unit. This is a possibility to integrate the pressure amplifier into a piston-cylinder-unit to make it as compact as possible.

In an embodiment of the invention the housing is part of a cylinder of the piston-cylinder-unit. Such a construction is very compact.

BRIEF DESCRIPTION OF THE DRAWINGS

The invention will now be described in more detail with reference to the drawing, wherein FIG. 1 a schematic front view of a pressure amplifier.

DETAILED DESCRIPTION

Figure 1:
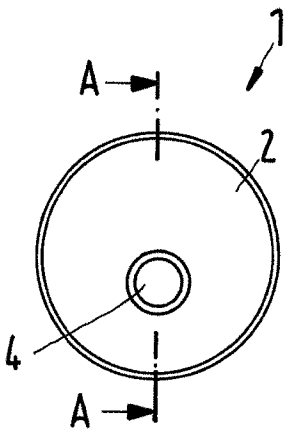

A pressure amplifier 1 comprises a housing 2 having a step bore. The bore comprises two sections i. e. a section with a larger diameter forming a low pressure area 3 and a section with a smaller diameter forming a high pressure chamber 4.

An amplification piston 5 is in form of a stepped piston having a first part 6 with a larger diameter and a second part 7 with a smaller diameter. The first part 6 comprises a front face forming a low pressure area 8. The outer diameter of the first part 6 corresponds to the inner diameter of the low pressure chamber 3.

The second part 7 comprises a front face forming a high pressure area 9. The outer diameter of the second part 7 corresponds to the inner diameter of the high pressure chamber 4.

A valve element 10 of a shifting valve 11 is located in the part of the bore forming the low pressure chamber 3. At an end opposite to the amplification piston 5 the low pressure chamber 3 is closed by a plug 12. The plug 12 comprises a circumferential wall 13 surrounding an end section 14 of the valve element 10. The end section 14 is a part of the valve element 10 having the smallest outer diameter.

In a direction towards the amplification piston 5 the end section 14 is followed by a protrusion 15 running in circumferential direction and forming the largest diameter of the valve element 10. A face of the protrusion 15 facing the plug 12 forms a shifting pressure area 16. The opposite side of the protrusion 15 forms a constant pressure area 17. The shifting pressure area 16 is larger than the constant pressure area 17.

In a direction towards the amplification piston 5 the protrusion 15 is followed by a front part 18 having a diameter between the end part section 14 and the diameter of the protrusion 15.

The part of the bore forming the low pressure chamber 3 comprises a step 19. The part of the bore forming the low pressure chamber 3 between the step 19 and the plug 12 has an enlarged inner diameter, this diameter corresponding to the outer diameter of the protrusion 15. Apart from this, the low pressure chamber 3 has an inner diameter corresponding to the outer diameter of the front part 18 of the valve element 10.

The protrusion 15 together with the step 19 form a first mechanical stop arrangement. Since the protrusion 15 is arranged in a middle part of the valve element 10, the first stop arrangement is arranged within the valve element 10 within a direction of movement.

The plug 12 together with a front face of the end section 14 forms a second mechanical stop arrangement.

The first mechanical stop arrangement is a limitation for the movement of the valve element 10 in a direction towards the amplification piston 5. The second mechanical stop arrangement is a mechanical limitation for the movement of the valve element 10 in a direction away from the amplification piston 5.

Apart from the bore forming the low pressure chamber 3 and the high pressure chamber 4 the housing 2 comprises a pressure channel 20, a tank channel 21 and a connection channel 22. In a way not shown the pressure channel 20 is connected to a pressure source, for example a pump. The tank channel 21 is connected to a tank or another container receiving fluid returning from the pressure amplifier 1. The connection channel 22 opens into the high pressure chamber 4 and into the low pressure chamber 3.

The second part 7 of the amplification piston 5 comprises a diameter reduction 23 or simply a groove starting in a predetermined distance from the high pressure area 9 and running in a direction towards the first part 6 of the amplification piston 5.

In a way not shown the high pressure chamber 4 is connected to the pressure channel 20 as well or is in another way connected to a pressure source.

The valve element 10 is in form of a hollow cylinder having a number of bores 24 in its cylinder wall.

Figure 2:
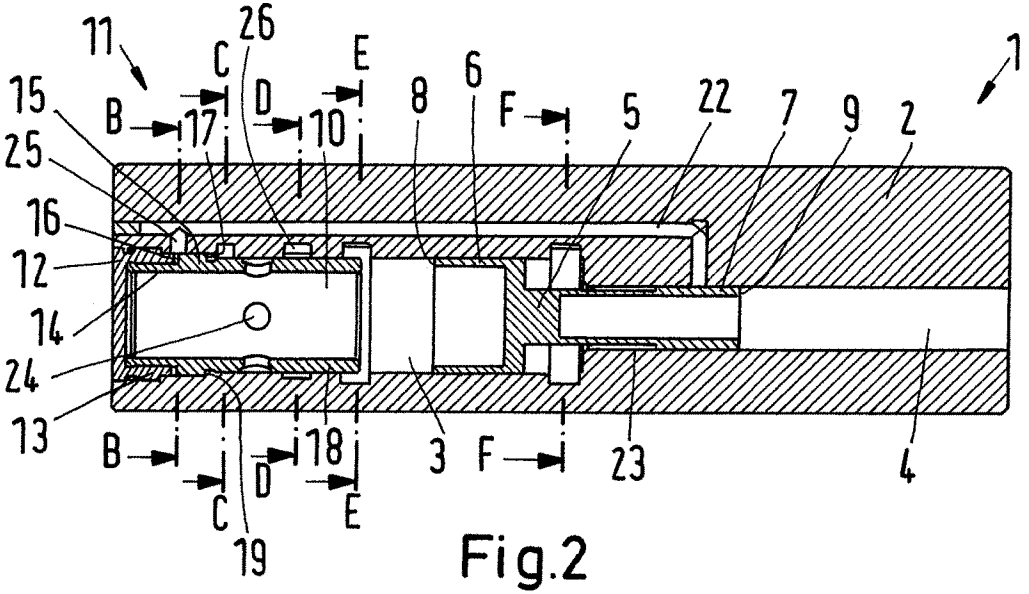
FIG. 2 is a section A-A of FIG. 1.

When the valve element 10 is in the position shown in FIG. 2, i. e. it contacts the plug 12, the pressure chamber 3 is connected to the tank channel 21 so that the tank pressure (or another low pressure) is present in the low pressure chamber 3.

Figure 7:
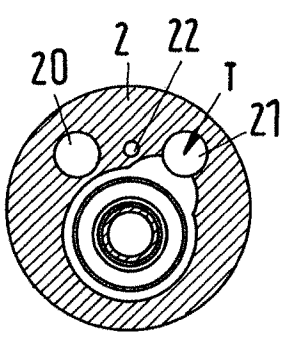
FIG. 7 shows a section F-F of FIG. 2.
Figure 6:
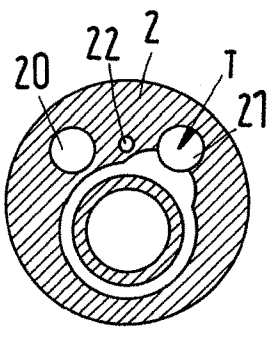
FIG. 6 shows a section E-E of FIG. 2

The high pressure area 9 of the amplification piston 5 is loaded by the pressure in the high pressure chamber 4 which corresponds to the supply pressure in the pressure channel 20. Therefore, the amplification piston 5 is moved in a direction towards the switching valve 11. During this movement fluid can be sucked out of the tank channel 21, as can be seen in FIG. 7.

When the amplification piston 5 has reached its end position or almost its end position in the direction of this movement, a connection between the connection channel 22 and the high pressure chamber 4 is established. The pressure in the high pressure chamber 4 is passed to the shifting pressure area 16 via a branch 25 of the connection channel 22.

Figure 5:
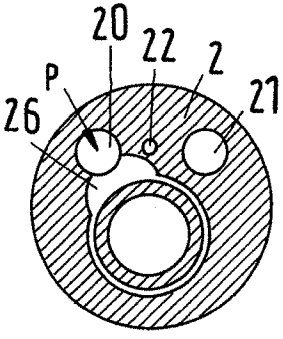
FIG. 5 shows a section D-D of FIG. 2.
Figure 4:
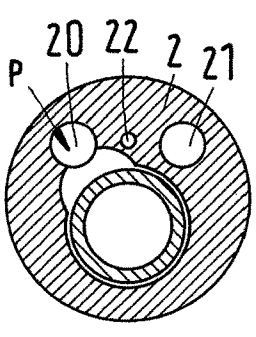
FIG. 4 shows a section C-C of FIG. 2.
Figure 3:
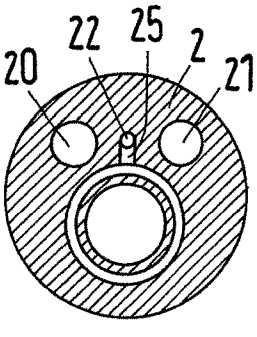
FIG. 3 is a section B-B of FIG. 2.

The constant pressure area 17 is permanently under der pressure of the pressure channel 20 (FIG. 4), i. e. supply pressure. Since the shifting pressure area 16 is larger than the constant pressure area 17 and the pressure acting on both sides is the same, the valve element 10 is shifted in a direction towards the amplification piston 5 until the protrusion 15 comes to rest against step 19. In this position the bores 24 come into an overlap relation with a groove 26 connected to the pressure channel 20 (FIG. 5). The supply pressure of the pressure channel 20 is now present in the low pressure chamber 3 and acts on the low pressure area 8 of the amplification piston 5. Since the low pressure area 8 is larger than the high pressure area 9 of the amplification piston 5 the amplification piston 5 is shifted in a direction away from the shifting valve 11 thereby generating a higher pressure in the high pressure chamber 4.

The movement of the amplification piston 5 continues until the diameter reduction 23 comes in overlapping relating with the connection channel 22. As soon as the diameter reduction 23 is an overlapping relation to the connection channel 22 a connection between the shifting area 16 and the tank channel 21 is established. Now the pressure acting on the constant pressure area is larger than the pressure acting on the shifting pressure area 16 and the valve element is moved back into the position shown in FIG. 2.

By having the shown fluid connection to the different areas, i. e. the shifting pressure area 16 and the constant pressure area 17, of the valve element 10 one achieves a quick response rate for the shifting valve 11 because the fluid can very quick come into action in that it can flow around the valve element.

In a way not shown in the drawing, the amplification piston 5 can have a stroke which is dimensioned so that it hits the valve element 10 at least in an end part of the return movement so that the valve element 10 is shifted mechanically in the return stroke.

In the return stroke of the amplification piston 5 the valve element 10 could also charge a spring arrangement or an accumulator filled with a compressible fluid like air or another gas so that either the spring or the pressure in the accumulator is used for forcing the valve element 10 together with the amplification piston 5 in the pressure intensifying direction. The force of the spring or the pressure in the accumulator form a kind of auxiliary force. The auxiliary force can be generated in another way as well.

The housing 2 can be part of a piston-cylinder-unit, in particular of the cylinder of the piston-cylinder-unit.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A pressure amplifier comprising a housing, an amplification piston in the housing having a high pressure area in a high pressure chamber and a low pressure area in a low pressure chamber, and a switching valve having a pressure controlled valve element having a large pressure area and a small pressure area, wherein the valve element and the amplification piston are located in a same bore in the housing, wherein the valve element is located in a part of the bore forming the low pressure chamber, wherein the low pressure chamber has an inner diameter corresponding to an outer diameter of a front part of the valve element, wherein the area of the large pressure area is greater than the area of the small pressure area, and wherein a difference in pressure applied to the large pressure area and the small pressure area causes the pressure controlled valve element to move in a first direction or in a second direction.

2. The pressure amplifier according to claim 1, wherein the large pressure area is a shifting pressure area being connected via the amplification piston to high pressure or to low pressure.

3. The pressure amplifier according to claim 1, wherein the housing is part of a piston-cylinder-unit.

4. The pressure amplifier according to claim 3, wherein the housing is part of a cylinder of the piston-cylinder-unit.

5. The pressure amplifier according to claim 1, wherein the amplification piston and the valve element have a common longitudinal axis.

6. The pressure amplifier according to claim 5, wherein the valve element has a first mechanical stop arrangement for a movement in the first direction and a second mechanical stop arrangement for a movement in the second direction opposite the first direction.

7. The pressure amplifier according to claim 5, wherein the large pressure area is a shifting pressure area being connected via the amplification piston to high pressure or to low pressure.

8. The pressure amplifier according to claim 1, wherein the amplification piston has a stroke dimensioned so that it hits the valve element at least in an end part of a return movement.

9. The pressure amplifier according to claim 8, wherein the valve element is loaded by an auxiliary force in a direction opposite to the return movement of the amplification piston.

10. The pressure amplifier according to claim 9, wherein the auxiliary force is at least partly generated by a spring arrangement.

11. The pressure amplifier according to claim 9, wherein the auxiliary force is at least partly generated by a pressure in an accumulator.

12. The pressure amplifier according to claim 1, wherein the valve element has a first mechanical stop arrangement for a movement in the first direction and a second mechanical stop arrangement for a movement in the second direction opposite the first direction.

13. The pressure amplifier according to claim 12, wherein the large pressure area is a shifting pressure area being connected via the amplification piston to high pressure or to low pressure.

14. The pressure amplifier according to claim 12, wherein the first mechanical stop arrangement is arranged in a middle part of the valve element in the first direction of movement.

15. The pressure amplifier according to claim 14, wherein the second mechanical stop arrangement is formed by a front face of the valve element and a plug closing the bore.

16. The pressure amplifier according to claim 14, wherein the large pressure area is a shifting pressure area being connected via the amplification piston to high pressure or to low pressure.

17. The pressure amplifier according to claim 12, wherein the second mechanical stop arrangement is formed by a front face of the valve element and a plug closing the bore.

18. The pressure amplifier according to claim 17, wherein the large pressure area is a shifting pressure area being connected via the amplification piston to high pressure or to low pressure.

19. The pressure amplifier according to claim 17, wherein the plug comprises a circumferential wall surrounding an end of the valve element.

20. The pressure amplifier according to claim 19, wherein the large pressure area is a shifting pressure area being connected via the amplification piston to high pressure or to low pressure.

21. A pressure amplifier comprising a housing, an amplification piston in the housing having a high pressure area in a high pressure chamber and a low pressure area in a low pressure chamber, and a switching valve having a pressure controlled valve element having a large pressure area and a small pressure area, wherein the valve element and the amplification piston are located in a same bore in the housing, wherein the valve element is located in a part of the bore forming the low pressure chamber, wherein the low pressure chamber has an inner diameter corresponding to an outer diameter of a front part of the valve element, wherein the area of the large pressure area is greater than the area of the small pressure area, and wherein the small pressure area is configured to be permanently fluidly connected to a supply pressure.

* * * * *